United States Patent [19]

Frost et al.

[11] Patent Number: 4,975,816

[45] Date of Patent: Dec. 4, 1990

[54] LENS FOR LOW LIGHT LEVEL LAMP

[75] Inventors: John S. Frost, Thousand Oaks; Mark R. Erickson, Oxnard; Kimberly E. Seegan, Agoura Hills; Bethanne Felder; Lloyd V. Wallace, both of Thousand Oaks, all of Calif.

[73] Assignee: Siemens Solar Industries, Camarillo, Calif.

[21] Appl. No.: 393,341

[22] Filed: Aug. 11, 1989

[51] Int. Cl.[5] ..... F21V 5/00

[52] U.S. Cl. ..... 362/332; 362/362

[58] Field of Search ..... 362/362, 363, 327, 329, 362/302, 304, 310, 342, 354, 299, 300, 333, 334, 431, 152, 153, 153.1, 332

[56] References Cited

U.S. PATENT DOCUMENTS

| | | | |
|---|---|---|---|
| 1,588,222 | 6/1926 | D'Olier, Jr. | 362/363 |
| 1,778,305 | 10/1930 | Blau | 362/363 |
| 3,015,720 | 1/1962 | Silverman | 362/431 |
| 3,197,631 | 7/1965 | Jensen | 362/431 |
| 3,805,055 | 4/1974 | Cassey | 362/431 |
| 4,175,661 | 11/1979 | Barnes | 362/363 |
| 4,254,405 | 3/1981 | Wenzlaff | 362/362 |
| 4,827,389 | 5/1989 | Crum | 362/431 |

FOREIGN PATENT DOCUMENTS

| | | | |
|---|---|---|---|
| 601339 | 3/1932 | Fed. Rep. of Germany | 362/363 |
| 630977 | 10/1949 | United Kingdom | 362/363 |

*Primary Examiner*—Ira S. Lazarus
*Assistant Examiner*—Richard R. Cole
*Attorney, Agent, or Firm*—Nilsson, Robbins, Dalgarn, Berliner, Carson & Wurst

[57] ABSTRACT

A lens for use in a stand alone lamp utilizing low wattage light bulbs. The lamp is powered through the utilization of photovoltaic cells which charge a battery which then provides power to the bulb in the absence of the sun. The lens is constructed of a hollow body having horizontally disposed ribs formed on the exterior surface thereof with a clear, unobstructed lower portion closing the bottom of the lens.

5 Claims, 1 Drawing Sheet

LENS FOR LOW LIGHT LEVEL LAMP

BACKGROUND OF THE INVENTION

This invention relates generally to illumination devices and, more particularly, to low light level lamps. More specifically the invention is directed to a lens for utilization in stand alone lamps powered by self-contained sources of electrical energy, including photovoltaic cells and particularly to a lens for use with such devices.

In the prior art there exists many low voltage lights which are useful for decorative and/or illumination purposes. The lamps may be utilized to illuminate walkways or to generally decorate garden areas or the like. Prior art lamps, for the most part, utilize public utility power sources. In addition, some prior art lamps utilize photovoltaic devices to charge batteries which, in turn, activate the lamps in the absence of sunlight. Such devices typically do not generate sufficient light to clearly illuminate pathways or garden areas such, for example, where security is desired, or the like. Alternatively, if sufficient illumination is provided, the battery power is insufficient to maintain the illumination for the time desired.

To overcome this problem, one must utilize a smaller power consuming light bulb and when such is done, the aesthetic appearance of the lamp is compromised.

SUMMARY OF THE INVENTION

A lens for utilization in a low light level lamp which includes a hollow body having a plurality of horizontally disposed ribs formed on the exterior surface thereof and a clear lower portion contiguous with the body and closing the bottom of the lens. Preferably the hollow body with the ribs is translucent, thereby causing the light striking the ribs to diffuse and to be soft in appearance, thus enhancing the aesthetic appeal of the lamp while at the same time permitting a maximum amount of light to be transmitted through the clear lower portion to illuminate the area surrounding the lamp.

DETAILED DESCRIPTION

Figure 1:
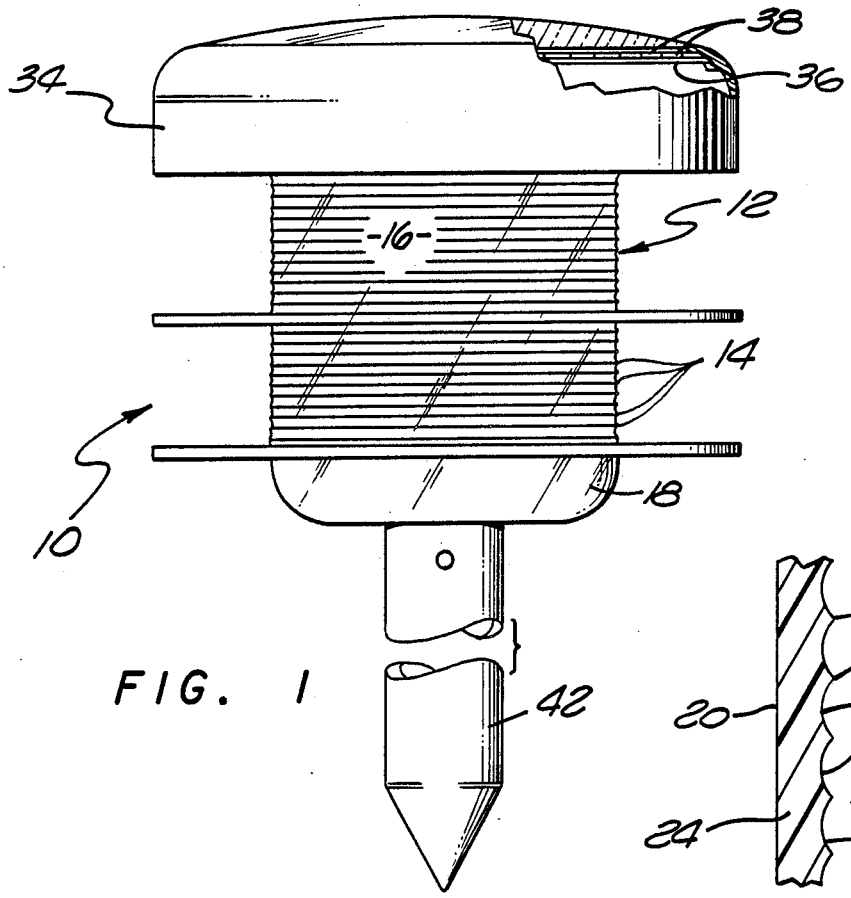
FIG. 1 is an elevational view showing a lamp utilizing a lens constructed in accordance with the principles of the present invention.

Referring now more particularly to FIG. 1, there is illustrated a stand alone low light level lamp which utilizes a lens constructed in accordance with the principles of the present invention. A lamp, as illustrated at 10, may be placed in position at any desired point for any particular application which may be desired. Although such is not shown in detail in FIG. 1, the lamp contains its individual source of electrical energy such, for example, as a battery which is maintained in a charged condition by the sun through the utilization of photovoltaic cells. When there is insufficient sunlight to generate electricity, an internal circuit illuminates a very low wattage bulb on the order of ½ to 1 watt which is maintained internally of the lamp 10 for purposes of illuminating the surrounding area.

Through the utilization of the lens 12, which will be described in greater detail below, there is provided a highly efficient utilization of the light which is available from a very low wattage bulb. This highly efficient utilization of the small amount of light available is accomplished through the unique design of the lens 12. The unique design includes the ribs 14, which are provided along the outer surface of the body portion 16 of the lens as well as the clear and unobstructed lower portion 18 which is contiguous with the body portion 16 of the lens 12.

Figure 4:
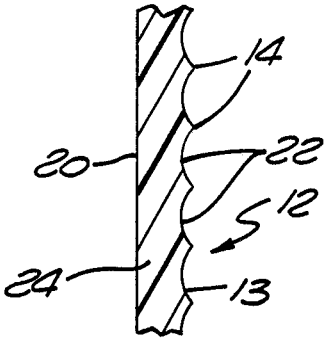
FIG. 4 is a cross-sectional view taken about the lines 4—4 of FIG. 3 clearly illustrating the ribs formed in the body portion of the lamp.

Preferably, the lens 12 is constructed of molded polycarbonate plastic which has high light transmissive characteristics as well as being impact resistant. As is shown more specifically in FIG. 4, the lens 12 has a smooth inner surface 20 and an outer surface 13 which is provided with a plurality of concave surfaces as shown at 22 thereby forming the ribs 14 therebetween. The polycarbonate plastic is molded to form the lens and the ribs are molded in situ at the time the lens is constructed. Through the utilization of the concave surfaces providing the horizontal ribs, the light from the light source is effectively transmitted with very small losses through the material 24 of the lens 12 As is clearly illustrated in FIG. 1, the ribs formed by the concave depressions 22 extend horizontally across the body portion 16 of the lens 12.

Contiguous with the body portion 16 is the lower portion 18 of the lens. The lower portion 18 is clear and unobstructed, that is, there are no ribs or other obstructions formed in the lower portion 18 of the lens. In this manner, the light, which is directed downwardly, passes through the high transmissive polycarbonate molded plastic and illuminates the areas surrounding the lamp 10 in a much more efficient manner. If desired, the body portion 16 of the lens 12 may be formed of translucent material to thus provide a more soft appearance and improve the aesthetics. However, to obtain the most effective and efficient use of the light available and to illuminate the surrounding area, the material would be clear molded polycarbonate or, alternatively, acrylic plastic, which provides a very tough and high light transmissive characteristics for the lens 12.

Figure 2:
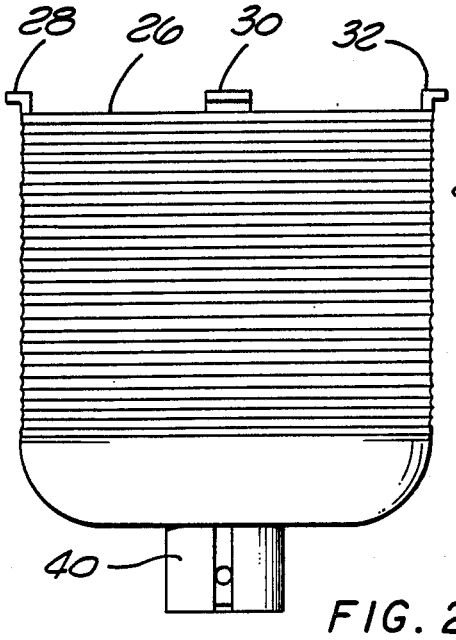
FIG. 2 is an elevational view of the lens.
Figure 3:
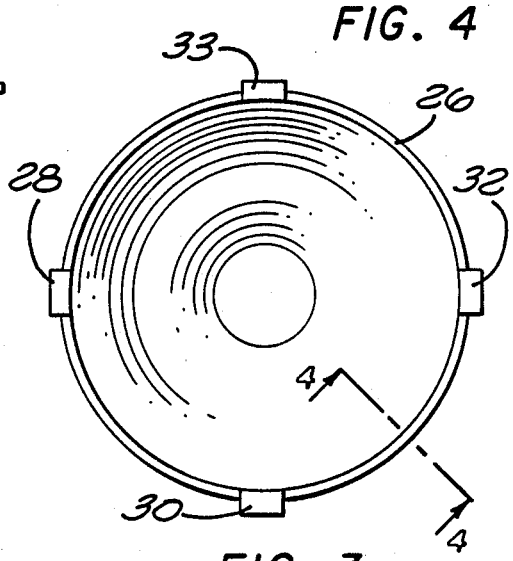
FIG. 3 is a top plan view of the lens.

As is illustrated more clearly in FIG. 2, the body portion 16 of the lens at its upper edge 26, has a plurality of lugs, as shown at 28, 30, 32 and 33 extending therefrom. These lugs are utilized to receive and secure in position a cap 34 to close the open upper end of the lens 12. Cooperative securing means would be provided internally of the cap 34 for receipt of the lugs 28, 30, 32 and 33 and would be recognized by those skilled in the art.

Positioned internally of the cap 34 is a plate 36 within which there is disposed photovoltaic cells 38 which, when exposed to sunlight, provide electrical energy to charge a battery (not shown) that provides electrical energy to the low wattage light bulb (not shown).

The lower portion of the lens 12 includes a protrusion 40 therefrom which is adapted to receive a stake 42 which is secured in place upon the protrusion 40. The stake 42 is utilized to place the lamp 10 at the desired position for illumination of the desired area. Through the utilization of the structure as above described, there is provided a stand alone self-powered lamp which is capable of utilizing a very low wattage bulb casting off a relatively small amount of light which is more efficiently utilized than has been the case with prior art lamps.

What is claimed is:

1. A lens for use in a low light level lamp comprising:

a hollow body portion having a smooth interior surface and an exterior surface;

a plurality of horizontally disposed ribs formed on said exterior surface between adjacent concave depressions on said surface to diffuse light falling thereon; and an enclosed lower portion contiguous with said body portion, said lower portion being clear and unobstructed to permit light falling thereon to freely pass therethrough.

2. A lens as defined in claim 1 wherein said hollow body portion is translucent.

3. A lens as defined in claim 1 wherein said hollow body portion includes an upper rim and lugs extending from said rim for use in securing a cover on said lens.

4. A lens as defined in claim 3 wherein said lower portion includes means for receiving a stake for supporting said lamp as a stand alone device.

5. A lens as defined in claim 1 wherein said lens is formed of a molded plastic material and said ribs are formed in situ during molding of said lens and extend along substantially the entire outer surface of said body portion.

* * * * *